US007984681B1

(12) United States Patent
Oxley et al.

(10) Patent No.: US 7,984,681 B1
(45) Date of Patent: Jul. 26, 2011

(54) AUTOMATIC PANEL SEWING AND FLANGING SYSTEM

(75) Inventors: Warren Oxley, Auburn, GA (US); John S. Chamlee, Lawrenceville, GA (US); Van H. Nguyen, Lawrenceville, GA (US); Danny V. Murphy, Dacula, GA (US); John P. Phillips, Lawrenceville, GA (US)

(73) Assignee: Atlanta Attachment Company, Lawrenceville, GA (US)

( * ) Notice: Subject to any disclaimer, the term of this patent is extended or adjusted under 35 U.S.C. 154(b) by 350 days.

(21) Appl. No.: 12/274,657

(22) Filed: Nov. 20, 2008

Related U.S. Application Data

(60) Provisional application No. 60/989,346, filed on Nov. 20, 2007.

(51) Int. Cl.
*D05B 35/10* (2006.01)
*D05B 27/00* (2006.01)

(52) U.S. Cl. ..... 112/2.1; 112/153

(58) Field of Classification Search ..... 112/2, 2.1, 112/10, 470.06–470.18, 470.26, 470.27, 112/470.33, 303, 311, 320
See application file for complete search history.

(56) References Cited

U.S. PATENT DOCUMENTS

| | | | | |
|---|---|---|---|---|
| 810,882 | A | 1/1906 | Phelps | |
| 1,233,945 | A | 7/1917 | Wodsedalek | |
| 1,322,842 | A | 11/1919 | Sutton | |
| 1,926,650 | A | 9/1933 | Reimer et al. | |
| 1,947,058 | A | 2/1934 | Pittoni | |
| 2,025,355 | A | 12/1935 | Mitchell | |
| 2,335,960 | A | 12/1943 | Patton | |
| 2,336,952 | A | 12/1943 | Olson | |
| 2,355,960 | A | 8/1944 | Duffle | |
| 2,772,425 | A | 12/1956 | Brodie | |
| 2,869,493 | A | 1/1959 | Seavert | |
| 2,945,238 | A | 7/1960 | Weiser | |
| 2,975,437 | A | 3/1961 | Freeman | |
| 3,013,513 | A | 12/1961 | Judelson | |
| 3,083,654 | A | 4/1963 | Cash, Sr. | |
| 3,109,182 | A | 11/1963 | Doak | |
| 3,173,159 | A | 3/1965 | Hart | |
| 3,190,247 | A | 6/1965 | Schifano et al. | |
| 3,490,061 | A | 1/1970 | Docker | |
| 3,641,954 | A * | 2/1972 | Kalning et al. | 112/2.1 |
| 3,673,906 | A | 7/1972 | Cash | |
| 3,802,361 | A | 4/1974 | Block | |
| 3,824,964 | A | 7/1974 | Ryan | |
| 4,013,026 | A | 3/1977 | Hall | |
| 4,014,273 | A | 3/1977 | Kosakai | |

(Continued)

FOREIGN PATENT DOCUMENTS

| | | |
|---|---|---|
| DE | 3139426 | 4/1983 |

(Continued)

*Primary Examiner* — Ismael Izaguirre
(74) *Attorney, Agent, or Firm* — Womble Carlyle Sandridge and Rice PLLC

(57) ABSTRACT

A system for automatically attaching a flanging material to the edges of a panel such as for a mattress, including a work table on which the panel is supported and a sewing assembly having a sewing machine located along a path of travel of the panel across the work table. The flanging material is fed from a supply of flanging material located adjacent the sewing assembly, and is attached to the side edges and about the corners of the panel by the sewing machine of the sewing assembly. A clamp mechanism engages and holds the panel as the sewing machine of the sewing assembly attaches the flanging material about the corners of the panel.

22 Claims, 7 Drawing Sheets

U.S. PATENT DOCUMENTS 4,019,447 A 4/1977 Blessing et al.
4,019,451 A 4/1977 Autrey
4,025,975 A 5/1977 Phillips et al.
4,043,282 A 8/1977 Fanghanel
4,061,327 A 12/1977 Blessing
4,067,269 A 1/1978 Fanghanel
4,073,246 A 2/1978 Crawford et al.
4,108,094 A 8/1978 Weigert
4,115,886 A 9/1978 Miller
4,117,790 A 10/1978 Hasegawa et al.
4,141,304 A 2/1979 Hasuda
4,155,317 A * 5/1979 Enomoto ..... 112/2.1
4,181,085 A 1/1980 Conner, Jr.
4,245,576 A 1/1981 Crawford et al.
4,280,421 A 7/1981 Price
4,290,376 A 9/1981 Brusasca
4,424,600 A 1/1984 Callaway
4,432,294 A 2/1984 Price et al.
4,460,350 A 7/1984 Mittal et al.
4,462,129 A 7/1984 Brannock
4,463,466 A 8/1984 May et al.
4,466,367 A 8/1984 Price et al.
4,498,404 A 2/1985 Sadeh
4,527,492 A 7/1985 Gill
4,616,584 A 10/1986 Vartoukian et al.
4,644,883 A 2/1987 Guin et al.
4,680,821 A 7/1987 Maguire
4,691,651 A 9/1987 Junemann
4,703,706 A 11/1987 Plante
4,742,789 A 5/1988 Pestel et al.
4,773,341 A 9/1988 Brocklehurst
4,776,579 A 10/1988 Romand et al.
4,793,463 A 12/1988 Kane
4,794,873 A 1/1989 Dordi et al.
4,809,375 A 3/1989 Bull
4,813,364 A 3/1989 Boxer
4,821,656 A 4/1989 Dordi et al.
4,825,787 A 5/1989 Babson et al.
4,827,856 A 5/1989 Rohr
4,838,186 A * 6/1989 Resta et al. ..... 112/2.1
4,893,574 A 1/1990 O'Neal et al.
4,901,657 A 2/1990 Fieschi
4,903,622 A 2/1990 Frey et al.
4,905,615 A 3/1990 Pofferi
4,958,579 A 9/1990 De Weers
4,998,965 A 3/1991 Easom
5,018,462 A 5/1991 Brocklehurst
5,042,098 A 8/1991 Stultz
5,100,127 A 3/1992 Melnick et al.
5,134,947 A 8/1992 Price et al.
5,137,190 A 8/1992 Plaud
5,145,144 A 9/1992 Resta et al.
5,159,889 A 11/1992 Price et al.
5,185,897 A 2/1993 Van Laanen
5,203,270 A 4/1993 Price et al.
5,282,433 A 2/1994 Freermann et al.
5,285,542 A 2/1994 West et al.
5,289,788 A 3/1994 Fukumoto
5,322,411 A 6/1994 Elkin et al.
5,341,755 A 8/1994 Kawasaki
5,367,968 A 11/1994 Diaz
5,368,431 A 11/1994 Willey et al.
5,373,798 A 12/1994 Price et al.
5,428,852 A 7/1995 Tenuta et al.
5,437,238 A 8/1995 Price et al.
5,475,881 A 12/1995 Higgens et al.
5,482,318 A 1/1996 Sollars, Jr.
5,483,909 A * 1/1996 Nogueras ..... 112/475.04
5,501,164 A 3/1996 Porter et al.
5,511,500 A 4/1996 Conley, Jr.
5,515,796 A 5/1996 Ogle et al.
5,522,332 A 6/1996 Price et al.
5,529,004 A 6/1996 Porter et al.
5,537,699 A 7/1996 Bonaddio et al.
5,542,775 A 8/1996 Bechtoldt et al.
5,560,308 A 10/1996 Eto
5,562,660 A 10/1996 Grob
5,586,511 A 12/1996 Porter et al.
5,617,802 A 4/1997 Cash
5,634,418 A 6/1997 Price et al.
5,645,002 A 7/1997 Brocklehurst
5,647,293 A 7/1997 Price et al.
5,655,241 A 8/1997 Higgins et al.
5,657,711 A 8/1997 Price et al.
5,664,508 A 9/1997 Mulcahey et al.
5,694,875 A 12/1997 Cash
5,697,309 A 12/1997 Ogle et al.
5,701,623 A 12/1997 May
5,704,084 A 1/1998 Evans et al.
5,724,686 A 3/1998 Neal
5,729,851 A 3/1998 Hollander
5,743,202 A 4/1998 Price et al.
5,769,015 A 6/1998 Kato
5,778,811 A 7/1998 Gill et al.
5,782,190 A 7/1998 Porter et al.
5,809,919 A 9/1998 Mitchell et al.
5,816,177 A 10/1998 Brocklehurst
5,865,135 A 2/1999 Price et al.
5,881,656 A 3/1999 Grant
5,896,605 A 4/1999 Branman
5,899,159 A 5/1999 Dasher et al.
5,908,004 A 6/1999 Porter et al.
5,915,319 A 6/1999 Price et al.
5,918,560 A 7/1999 Dasher et al.
5,924,376 A 7/1999 Olewicz et al.
5,943,971 A 8/1999 Trickett et al.
5,970,548 A 10/1999 Welch
5,974,609 A 11/1999 Nunez et al.
5,975,881 A 11/1999 Langos et al.
5,979,345 A 11/1999 Price et al.
5,983,814 A 11/1999 Block
6,000,352 A 12/1999 Porter et al.
6,035,794 A 3/2000 Keeton
6,041,456 A 3/2000 Pharr
6,055,921 A 5/2000 Olewicz et al.
6,088,858 A 7/2000 Juster et al.
6,125,488 A 10/2000 Vogland et al.
6,129,030 A * 10/2000 Resta ..... 112/2.1
6,202,579 B1 3/2001 Olewicz et al.
6,209,468 B1 4/2001 Marcangelo et al.
6,263,532 B1 7/2001 Miller
6,276,009 B1 8/2001 Schrougham
6,279,869 B1 8/2001 Olewicz
6,293,213 B1 9/2001 Block et al.
6,295,481 B1 9/2001 Price
6,397,768 B1 6/2002 Dasher et al.
6,408,773 B2 6/2002 Resta
6,530,335 B1 3/2003 Halfmann et al.
6,532,608 B2 3/2003 Schreiner
6,574,815 B2 6/2003 Freeman et al.
6,648,585 B2 11/2003 Block et al.
6,715,173 B2 4/2004 Barman et al.
6,721,982 B2 4/2004 Freeman
6,760,935 B1 7/2004 Burton et al.
6,802,271 B2 10/2004 Oxley et al.
6,804,849 B2 10/2004 Van Patten
6,834,603 B1 12/2004 Rudderman et al.
6,874,215 B2 4/2005 Flippin
6,883,446 B2 4/2005 Koerner
6,889,622 B2 5/2005 Marcangelo
6,994,043 B1 2/2006 Price
7,021,227 B2 4/2006 Marcangelo
7,100,525 B1 9/2006 Price et al.
7,383,780 B1 6/2008 Oxley et al.
7,412,936 B2 * 8/2008 Price et al. ..... 112/475.08
7,543,364 B1 6/2009 Price et al.
7,647,876 B2 1/2010 Oxley et al.
2001/0032361 A1 10/2001 Schreiner
2002/0050117 A1 5/2002 Dasher et al.
2002/0144352 A1 10/2002 Freeman et al.
2004/0129189 A1 7/2004 Oxley et al.
2009/0064911 A1 3/2009 Oxley et al.

FOREIGN PATENT DOCUMENTS

DE 3712493 11/1987
EP 0200368 11/1986
EP 0264618 4/1988

| | | |
|---|---|---|
| EP | 0320468 | 8/1989 |
| EP | 0330285 | 8/1989 |
| EP | 0682135 | 11/1995 |
| FR | 1567893 | 5/1969 |
| GB | 1233945 | 6/1971 |
| GB | 1384073 | 2/1975 |
| JP | 7308465 | 11/1995 |
| WO | WO9212282 | 7/1992 |
| WO | WO9525194 | 9/1995 |
| WO | WO02065877 | 8/2002 |

* cited by examiner

AUTOMATIC PANEL SEWING AND FLANGING SYSTEM

CROSS REFERENCE TO RELATED APPLICATIONS

The present Patent Application is a formalization of previously filed, co-pending U.S. Provisional Patent Application Ser. No. 60/989,346, filed Nov. 20, 2007 by the inventors named in the present Application. This Patent Application claims the benefit of the filing date of this cited Provisional Patent Application according to the statutes and rules governing provisional patent applications, particularly 35 U.S.C. §119(a)(i) and 37 C.F.R. §1.78(a)(4) and (a)(5). The specification and drawings of the Provisional Patent Application referenced above are specifically incorporated herein by reference as if set forth in their entirety.

FIELD OF THE INVENTION

The present invention generally relates to sewing systems and methods for forming mattresses, and in particular, to a system and method of sewing and/or attaching a panel of a mattress or other bedding article to a flanging material.

BACKGROUND OF THE INVENTION

In the textile field, most sewing operations traditionally have been extremely labor intensive, manual operations that generally have required skilled workers for cutting, sewing, and finishing textile articles. The more labor intensive the sewing operation and the greater the skill required of the operator to form the article, the greater the cost and the slower the production of such articles. For example, in the manufacture of mattresses, and especially when forming a pillowtop mattress, a top panel that includes a foam or cushion material is sewn to a flanging material, after which it is applied over a spring set for the mattress, with the flanging material being pulled down over the side edge of the spring set and hog ringed or stapled to a spring to secure the top panel of the mattress thereto. A border then typically is attached about the sides of the mattress, covering the flanging material and springs. Further, the upper panels and pillowtops of mattresses generally must be sewn or attached to the mattress border, pillowtop attachment gusset, and possibly a flanging material, by a tape edge, which is applied along the mating edges or seams therebetween by a tape edge applicator.

Currently, there exist automated systems that enable workers to measure, cut, and sew borders, attachment gussets, flanging materials and other parts of a mattress or foundation. A drawback of such automated equipment is that it typically has been limited in the type and number of sewing operations that can be performed, while other operations, such as applying tape edges about the borders and pillowtops of mattresses, still tend to require significant skill and manual control by an operator to be performed. As a consequence, while various components of a mattress or foundation set can be formed at increased rates, the final assembly of the mattress or foundation set generally is still limited to more labor intensive, manual operations.

SUMMARY OF THE INVENTION

Briefly described, the present invention generally relates to an automatic panel sewing and flanging system and a method of trimming and attaching a flanging material to a panel, such as a quilted fabric or other textile panel for use in forming mattresses, foundation sets, and/or other similar articles. The present invention is adapted to attach the flanging material along the side edges and about a corner portion of the panel, with less pleating and distortion to achieve more accurate rounded or accurate corners. The automatic panel sewing and flanging system of the present invention is designed to further receive and automatically sew and attach a flanging material to the panels as needed while enabling a single operator to operate multiple systems, with the panels received from a conveyor or other transport mechanism from one or more quilting machines, or alternatively, from other sewing systems or stations, or supplied from inventory or other supply means.

The automatic panel sewing and flanging system generally will include a large air-assisted work table having a series of air jets or ports mounted or formed therein for aiding in the movement of the panels across the work table. A sewing assembly or workstation generally will be mounted along one of the sides of the work table. The sewing assembly or workstation will include a single or multiple needle sewing head mounted on a turntable and having one or more sewing needles and an edge trimming or cutting blade, with a roll of flanging material further generally being mounted adjacent the sewing head, and a flange cutter located downstream from the sewing head. A panel generally will be loaded either automatically from the conveyor or other transport, or manually into a sewing position under the foot of the sewing head and then will be guided and sewn along the edge of the panel. As the sewing head sews along the edge of the panel, the trimming/cutting blade generally trims away excess material, while the sewing head forms a chain stitch and an over-edge stitch or safety stitch along the cut panel edge. During this sewing operation, the sewing head also can attach the flanging material to the trimmed edge of the panel. Alternatively, the system can be operated without the attachment of the flanging material if so desired.

As a corner of the panel is detected approaching the sewing head, the sewing head generally will be slowed and can be stopped and with the needle(s) of the sewing head near the corner of the panel. One or more clamps then can be lowered into a position offset from the edges of the panel, so as to engage and hold the corner of the panel against the work table. The sewing head, which is mounted on a turntable-style base, then generally can be rotated in a substantially arcuate motion about an arc of approximately 90 degrees, or other rotational movement as needed to sew about the corner as desired. During rotation, the sewing head generally will be operated as it is rotated around the corner of the panel to perform the corner sewing process, so as to cut and sew, and attach a flanging material as needed along a substantially consistent radius about the corner of the panel.

Because the panel is being held stationary during the corner sewing process, a substantially more uniform and consistent corner radius can be achieved. Once the sewing head has completed its rotation about the corner of the panel, the sewing head then can be rotated back to its home or initial sewing position, with the quilted panel also being rotated by movement of at least one of the clamps with the movement of the sewing head, so as to be placed into a position to present its next side edge in the path of travel for sewing therealong. As a result, a rectangular, square or other configuration panel can be formed that is sewn along all four sides of the panels with a substantially more consistent and accurate radiused edge being formed about each corner, with or without flanging material also being attached along each edge of the panel.

Various objects, features and advantages of the present invention will become apparent to those skilled in the art upon a review of the following detailed description, when taken in conjunction with the accompanying drawings.

DETAILED DESCRIPTION

Figure 1:
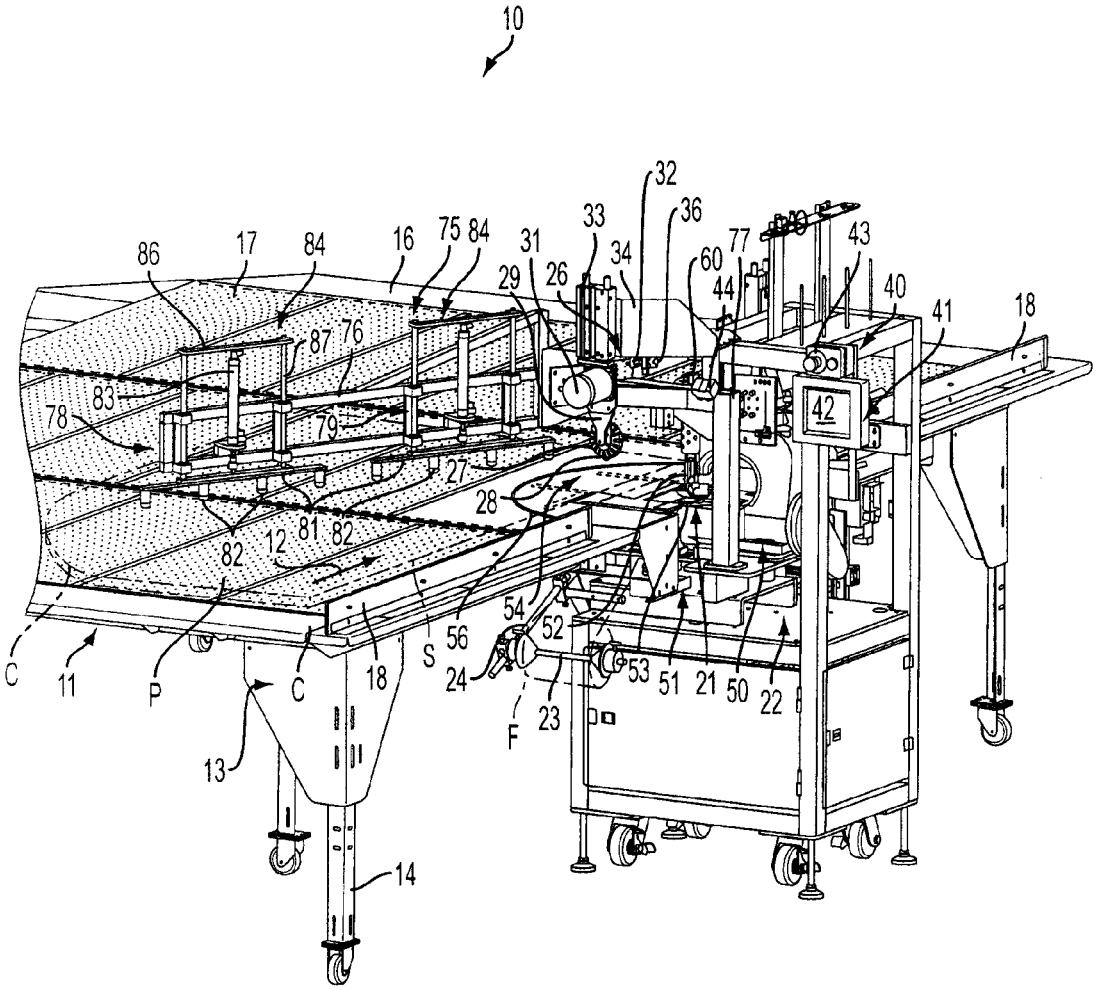
FIG. 1 is a perspective view of one embodiment of the automatic panel sewing and flanging system according to the principles of the present invention.
Figure 2A:
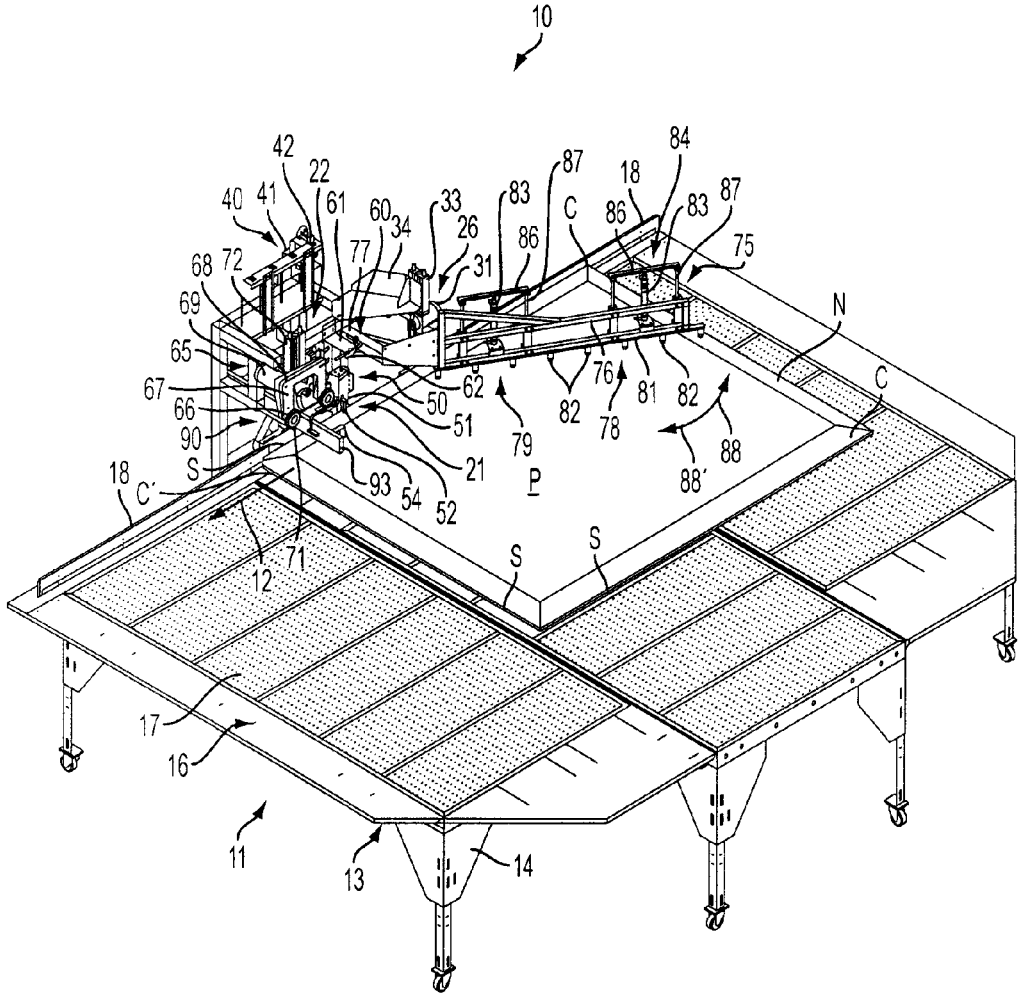
FIGS. 2A-2C are perspective views illustrating the sewing of a panel by the automatic panel sewing and flanging system of the embodiment of FIG. 1.
Figure 2B:
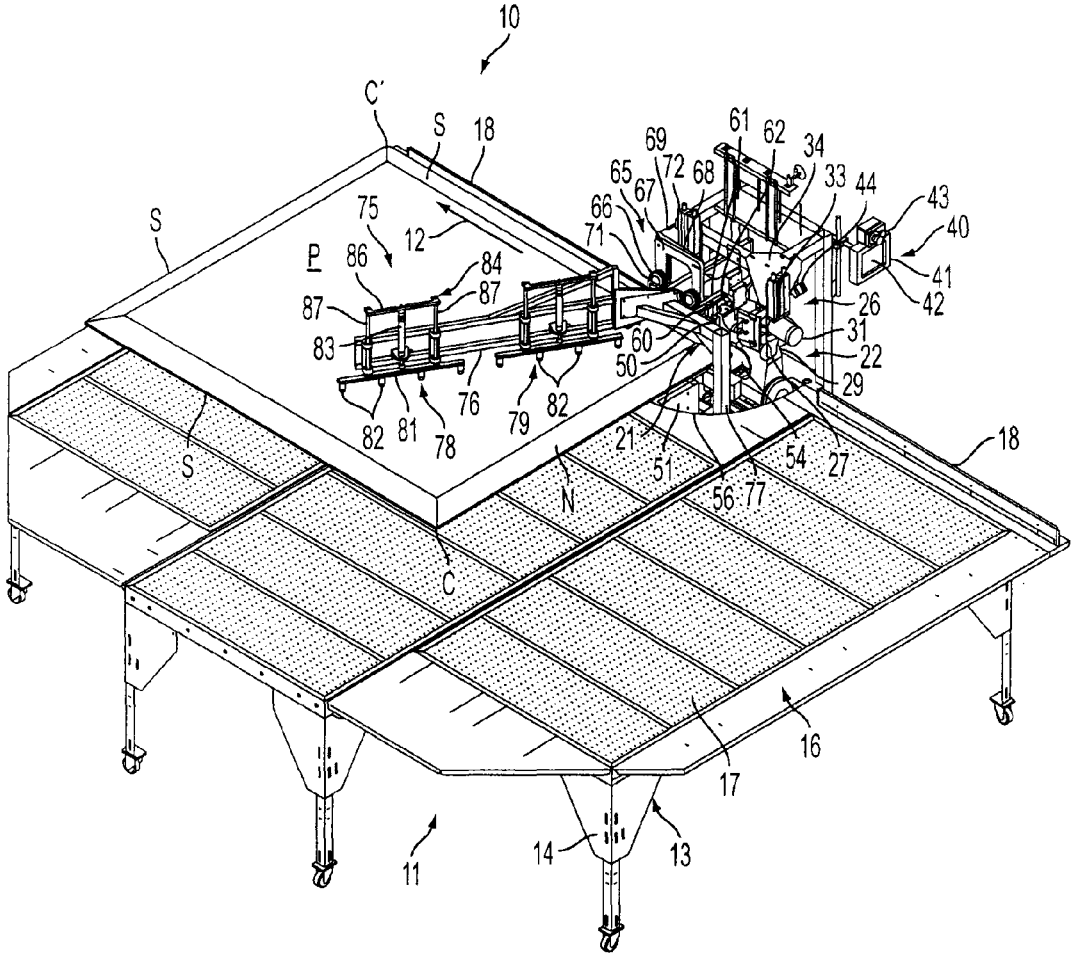
Figure 2C:
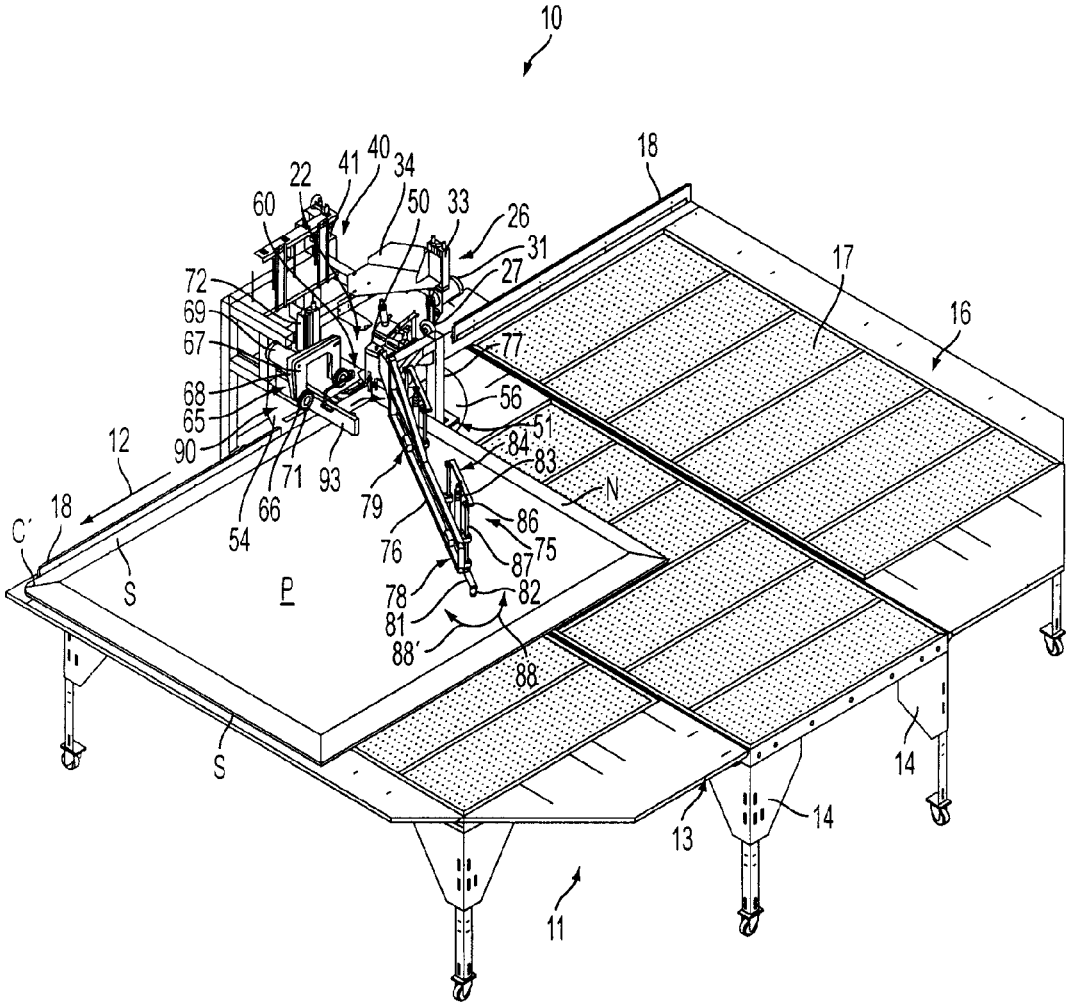
Figure 3:
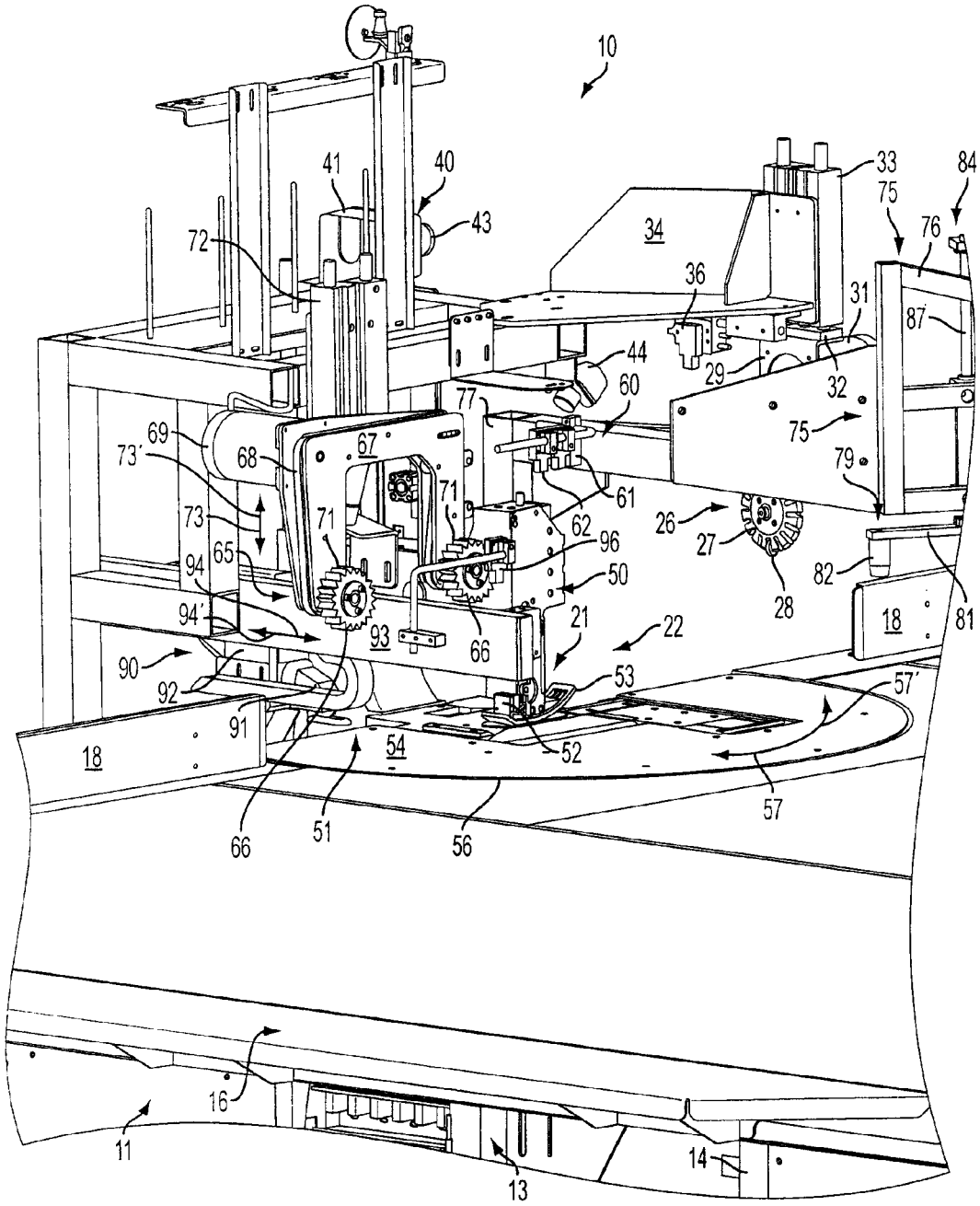
FIG. 3 is a perspective view of the sewing assembly of the automatic panel sewing and flanging system of the embodiment of FIG. 1.
Figure 4A:
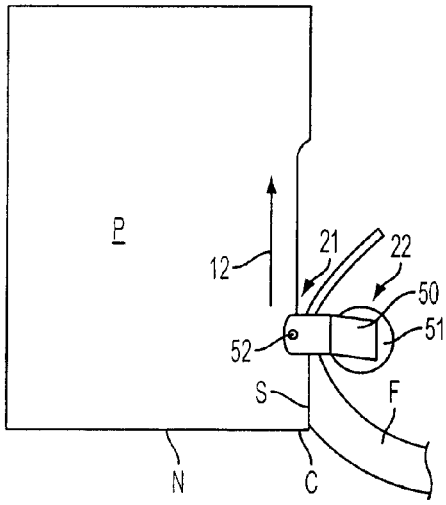
FIGS. 4A-4C are views schematically illustrating the operation of the automatic panel flanging system according to the present invention for trimming and attaching the flanging material to a panel, including the attachment of the flanging material about a corner portion of the panel.
Figure 4B:
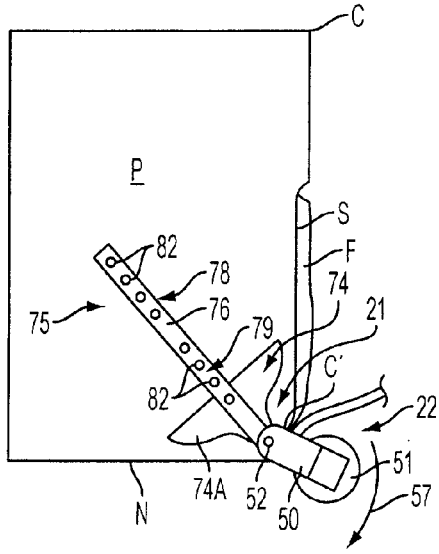
Figure 4C:
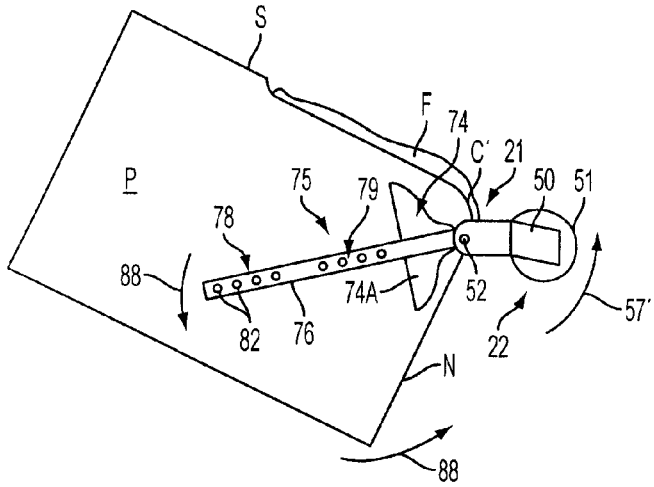
Figure 5:
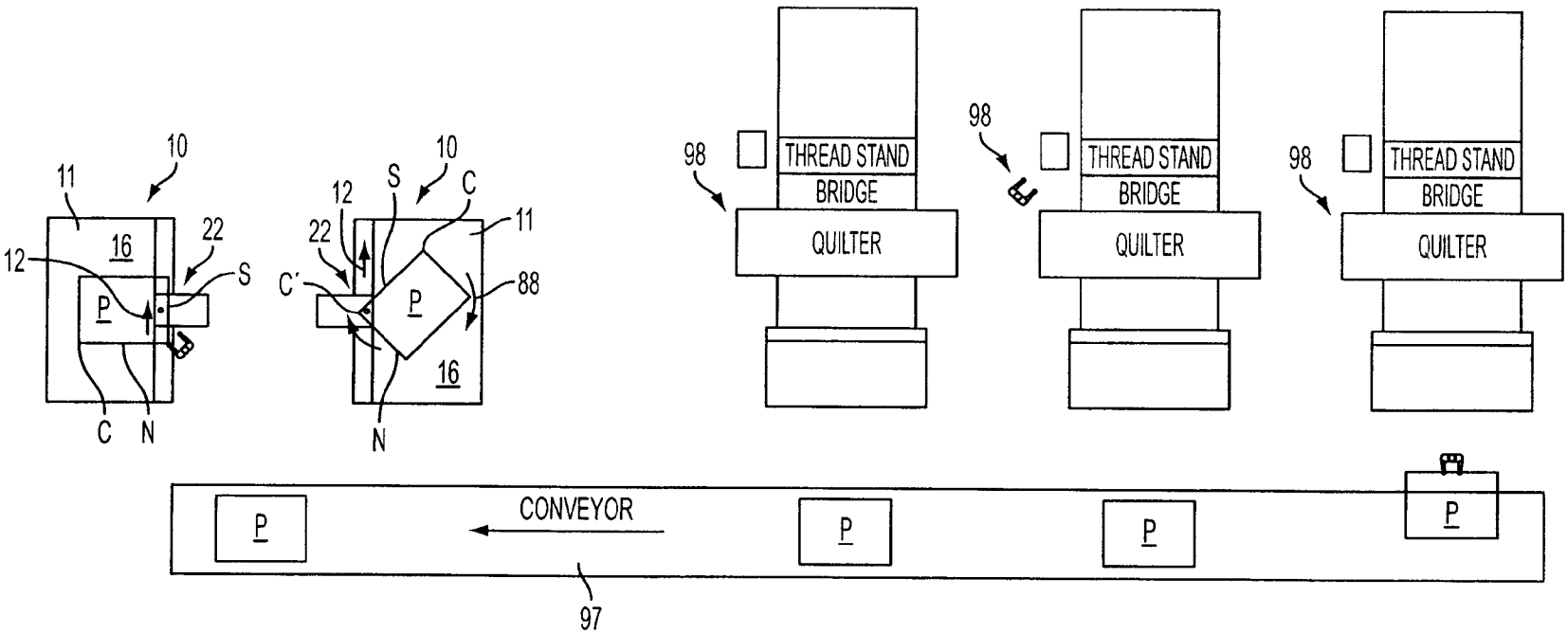
FIG. 5 is a schematic illustration showing the automatic panel sewing and flanging system of the present invention in line for receiving quilted panels from a series of quilting machines.

Referring now to the drawings in which like numerals indicated like parts throughout the several views, FIGS. 1-3 generally illustrate one embodiment of the automatic panel sewing and flanging system 10 according to the principles of the present invention, while FIGS. 4A-5 schematically illustrate an example embodiment of the method of operation of the automatic panel sealing and flanging system. In general, the automatic panel sewing and flanging system can receive a panel P, such as a quilted fabric or other textile panel for use in forming mattresses, foundation sets and/or other similar articles, for trimming and sewing of the side edges S thereof. The present invention is further adapted to attach a flanging material F along the side edges S and about corner portions C of the panel with pleating and distortion of the corner portions of the panel being sewn being substantially minimized and with the panel thus being formed with more accurate or consistent corners, including formation more consistently sized and sewn radiused corners.

As generally illustrated in FIGS. 1-2C, the automatic panel sewing and flanging system 10, according to at least one example embodiment of the system, generally includes a work table 11 on which a panel P (shown in phantom lines) is supported and moved along the path of travel indicated by arrow 12 for attaching the flanging material F (shown in phantom lines) thereto. The work table 11 can be an air-assist table and generally includes a frame 13 supported on a series of standing legs 14, and an upper surface 16 on which the panel is received and moved. The upper surface 16 of the work table 11 generally will be formed from a substantially smooth, reduced friction material, such as a polished metal material, plastic or other, similar material, and further can be formed with a series of perforations or ports 17 through which pressurized air can be directed so as to cause the panels being supported thereon to "float" on top of the upper surface 16 of the work table to provide an "air-assist" as the panels are moved along their path of travel indicated by arrow 12. A supply of pressurized air (not shown), such as a blower, air tank, etc., typically will be connected to the ports of the support table for supplying the flow of pressurized air therethrough. Additionally, at least one guide plate 18 can be mounted along a side edge of the work table, as indicated in FIGS. 1-2C, so as to provide a fixed guide against which a side edge S of the panel P, which is to be sewn or attached to the flange material F, can be engaged and moved so as to help maintain the side edge substantially in alignment with a sewing zone 21 of a downstream sewing assembly 22 for attaching the flanging material to the side edge of the panel.

As further indicated in FIG. 1, a roll of the flanging material F typically is supported on a spool or support rod 23 attached by an arm or brace 24 to the frame 13 of the work table 11. The arm 24 further can be adjustable so as to adjust the location or orientation of the flanging material as it is fed into the sewing assembly 22. Additionally, as FIGS. 1 and 3 illustrate, an edge guide mechanism 26 can be mounted above the work table, along the path of travel 12 of the panels, and generally is positioned upstream from the sewing zone 21 of the sewing assembly 22 for controlling the feeding of the side edge S of the panel into the sewing zone to help ensure substantially consistent sewing and trimming of the side edges of the panels. In the present embodiment, the edge guide mechanism 26 is an active edge guide mechanism that engages and moves the side edge of the panel back and forth, laterally across the path of travel 12 of the panel. As indicated in FIGS. 1 and 3, the edge guide mechanism 26 further generally includes a guide member 27, here shown as a toothed or segmented wheel having at least one tab or engaging member 28 that contacts the upper surface of the panel. The guide member is rotatably supported by plate 29 (FIG. 1), which further supports a reversible, variable speed drive motor 31 for driving the guide member to thus cause the back and forth or lateral movement of the side edge of the panel across its path of travel as needed to ensure substantially consistent alignment of the side edge with the sewing zone of the sewing assembly. Plate 29 further generally is attached to a bracket 32 that is connected to a cylinder 33, or similar actuator, mounted to a frame support 34 affixed to the frame 13 of the work table so as to support the guide member and drive motor in a desired location above the surface 16 of the work table. The cylinder 33 can include a rodless cylinder, hydraulic or pneumatic re-actuated cylinder, or other similar actuator, which is adapted to move the guide member 27 vertically as needed for engaging panels of varying thicknesses.

As illustrated in FIG. 3, a sensor 36, such as a photoelectric eye, proximity sensor or other, similar sensor or detector also generally will be mounted to the frame support 34 for the edge guide mechanism 26 along the downstream side thereof. The sensor 36 generally is directed at a desired point or location along the path of travel of the side edge of the panel being sewn, so as to detect a presence or absence of the panel side edge. The sensor 36 reports the presence or absence of the side edge of the panel to a control system 40 (FIG. 1) for the automatic panel sewing and flanging system 10, in response to which the operation of the drive motor 31 is controlled so as to cause the guide member 27 to be moved or rotated in opposite directions as needed for moving the panel edge back across the path of travel of the panel so as to substantially maintain the side edge of the panel in a desired alignment for sewing.

The control system 40 generally includes a processor or controller 41, which can include a user interface, here shown as a touch screen 42, although other types of user interfaces, such as a keyboard and monitor, mouse, etc. also can be utilized. The controller 41 can be programmed with operational controls or parameters for sewing of the panels, and can provide feedback and the ability for the operator to adjust various parameters such as pile height, movement of the sewing assembly, etc. Additionally, stop and start switches 43 and a thumb switch 44 can be provided adjacent the sewing assembly 22 for activating and/or stopping the operation of the automatic panel sewing and flanging system.

As illustrated in FIGS. 1 and 3, the sewing assembly 22 generally includes a sewing head or sewing machine 50 that is mounted to a rotatable base or turntable 51. The sewing machine 51 generally is a double needle sewing machine, typically a "safety stitch" sewing machine, and generally includes a pair of sewing needles 52. The outside needle generally will form a chain stitch along the panel side edge, while the inside needle generally will form an over edge stitch, together forming a safety stitch along the side edges of the panel. The sewing machine further generally will include an edge trimmer or cutting blade below the presser foot 53 of the sewing machine for trimming away a portion of the side edge of the panel outside the safety stitch as the side edge is sewn and/or flanged. The sewing needles and presser foot define the sewing zone 21 through which the side edge of the panel to be sewn is passed for trimming and sewing of the flanging material thereto.

As also indicated in FIGS. 1-3, the turntable or base 51 in which the sewing head 50 is mounted further includes a rotatable platform 54 that projects forwardly into a cutout or portion or recess 56 formed in the upper surface 16 of the work table 11 and supports the panel in the sewing zone 21. The platform 54 generally is formed from a similar reduced friction, non-stick material as the material of the upper surface 16 of the work table 11, and as indicated in FIG. 3, generally has a substantially circular or arcuate configuration so as to be able to rotate freely within the cutout portion 56 in the direction of arrows 57 and 57'. During the sewing operation of the automatic panel seaming and flanging system 10, as a corner C of the panel P (FIG. 1) approaches the sewing zone 21, the further movement of the panel along the path of travel 12 can be stopped and the sewing head 50 rotated in the direction of arrow 57 so as to sew a substantially consistent radiused corner in the C', as indicated in FIGS. 2B and 2C and 4B-4C.

Such a corner sewing operation generally is initiated by detection of the next side edge N (FIGS. 2A-2C) or end of the panel P approaching the sewing zone 21 by a panel sensor array 60. As indicated in FIG. 3, the panel sensor array 60 generally includes first and second or upstream and downstream sensors 61 and 62, respectively, which detect the approach of the next side edge of the panel at a desired location or distance upstream from the sewing zone. The first or upstream sensor detects the passage of the next side edge of the panel thereunder, and signals the control system 40 to slow the further movement of the panel through the sewing zone, while detection of the next side edge of the panel by the downstream sensor 62 signals the control system to stop further movement of the panel along its path of travel and to begin a corner sewing operation.

As further illustrated in FIGS. 2A-3, a material puller 65 generally can be provided downstream from the sewing head 50 to assist in pulling heavier or thicker panels through the sewing zone. The material puller 65 is illustrated in one embodiment as including a pair of puller rolls 66 mounted on a support frame 67 and linked via a drive belt 68. A drive motor 69 additionally is mounted to the support frame 67 and drives the drive belt 68 so as to cause the puller rolls 66 to be rotated. Each of the puller rolls 66 generally is a toothed sprocket or gear having a series of teeth 71 arranged thereabout for engaging and pulling the panel P (FIGS. 2A-2C) through the sewing zone. The support frame 67 further is mounted on a cylinder 72, such as a rodless cylinder, or similar actuator for raising the lowering the puller rolls 66, as indicated by arrows 73, 73' into and out of engagement with the panel material passing therebelow. For example, for thinner, lighter weight panels, the puller rolls may not be required and thus can be removed out of engagement with the panel, or, for heavier panels which require additional pulling for drawing than through the sewing zone, the puller rolls can be lowered to a position sufficient to engage and grip and thus pull the panel material through the sewing zone.

A first or corner clamp mechanism 74 (FIGS. 4B-4C) can be provided adjacent the sewing head. The corner clamp generally will include a foot or clamp plate 74A moveable into tight, compressive engagement with the panel, and can be actuated at the start of a corner sewing operation for assisting and holding the panel against the work table during a corner sewing operation. A second or rotatable clamp mechanism 75 also can be provided for reorienting the panel as needed to present the next side edge thereof for sewing. The rotatable clamp mechanism 75 generally includes a clamp arm 76 that is rigidly mounted to an upstanding frame support 77 so as to rotate with the turntable 51 as indicated in FIGS. 1-2C. The frame support 77 for the clamp arm 76 further can be pivotable or rotatable independently of the rotation of the turntable 51 of the sewing assembly 22 such that the clamp arm 76 can be rotatable in the direction of arrows 88 and 88', as indicated in FIG. 2C, so as to rotate the panel by an amount sufficient to present the next side edge into the path of travel for sewing. For example, as indicated in FIGS. 2A and 2C, the panel can be rotated by approximately 90 degrees so as to re-arrange or re-orient the panel and thus present the next side edge for sewing. A series of clamp assemblies 78 and 79 can be mounted at spaced locations along the clamp arm 76. While two clamp assemblies 78 and 79 are shown, it will be understood by those skilled in the art that lesser or greater numbers of clamp assemblies also can be utilized depending upon the length of the clamp arm and/or size of the panels to be sewn and flanged.

Each of the clamp assemblies 78/79 (FIGS. 1-2C) generally includes elongated plate 81 on which a series of clamp feet or projections 82 are mounted in space series therealong. An actuator, such as an air cylinder 83 or similar actuator generally controls the vertical movement of the clamp plates, and thus the clamp feet 82 into and out of engagement with the panel P moving thereunder to enable selective actuation of the clamp assemblies. Each cylinder 83 typically controls movement of its clamp plate 81 via a support bracket assembly 84, here shown as including an upper plate 86 to which one end of the cylinder 83 is mounted, and which is connected at its opposite ends to drive rods 87. Thus, as the cylinder 83 is raised and lowered, it causes support plate 86, and thus the clamp plate 81 connected thereto by drive rods 87 to be raised and lowered so as to move the clamp feet 82 into and out of engagement with the panel P.

Additionally, as indicated in FIG. 3, a flange cutter 90 further can be mounted downstream from the sewing zone 21 and will be moveable across the path of travel of the panel for cutting the trailing edge of the flanging material therefrom. The flange cutter 90 generally includes a electronically actuated or pneumatically actuated cutting blade 91 or a rotary cutter mounted on a carriage 92 attached to a cylinder 93, such as a rodless cylinder for controlling movement of the cutter in the direction of the arrows 94 and 94' from a retracted position as indicated in FIG. 3, to an extended position across the path of travel of the panel through the sewing zone so as to sever any trailing portion of the flanging material and any remaining thread chain in order to finish the sewing and flanging of the panel edges. A cutter sensor 96 further generally is mounted adjacent the downstream edge of the sewing zone in a position for detecting the last finished corner of the panel P and signaling the control system to actuate the flange cutter. The cutter sensor can be a photo-electric eye, proximity sensor or similar sensor that detects the presence or absence of the paneling material passing thereunder.

In operation of the automatic panel sewing and flanging system 10 according to the principles of the present invention, as illustrated in FIGS. 2A-2C and 4A-4C, a panel P generally will be received or placed on the upper surface of the work table 11. As indicated in FIG. 5, the panels can be received from a conveyor system 97 or similar material handling system with quilted panels being received directly from one or more quilting machines 98, and with the panels being fed directly from the conveyor either manually by an operator, or by an automated material handling system, such as transfer belt, material handling robot, etc. Alternatively, the panels can be individually fed by an operator from a supply or stack of panels. Additionally, since the automatic panel sewing and flanging system can be operated automatically, without requiring manual control by the operator to sew or attach the flanging material to the panels, the operator can be free to operate multiple panels sewing and flanging systems at the same time.

As the panel is moved along its path of travel 12 through the sewing zone 21 of the sewing assembly 22, the sewing head 50 sews and trims along the side edge S of the panel so as to attach the flanging material F to the side edge, while trimming away excess material from the side edge of the panel as indicated in FIG. 4A. As the panel is fed into the sewing head, its side edge being sewn is monitored and the panel is engaged and moved by an active edge guide mechanism 26 so as to substantially maintain the side edge of the panel in a consistent alignment as it moves along its path of travel to ensure substantially consistent trimming and sewing of the side edges of the panels. When a corner portion C of the panel approaches the sewing head, it is detected by the panel sensor array 60 (FIG. 3). As the next side edge of the panel passes under the first or upstream sensor 61, the control system is signaled so as to slow the further movement of the panel along its path of travel, and after detection of the next side edge by the downstream or second sensor 62, the control system is signaled to stop further movement of the panel, and to thereafter engage the corner clamp mechanism 74 (FIG. 4B).

Upon actuation of the corner clamp mechanism, the clamp is engaged against the panel so as to compress and hold the panel against the upper surface of the work table and prevent further movement thereof. Thereafter, as indicated in FIGS. 2B-2C and 4B, the sewing head 50 will be rotated or otherwise moved about the corner portion of the panel so as to trim and attach the flanging material about the corner portion C of the panel. Thus, rather than moving the corner of the panel with respect to the sewing head, the sewing head of the present invention is rotated or moved and sews about the corner of the panel in order to generally form a more consistent corner portion for the panel. Typically, the sewing head will be moved along in a substantially arcuate path over a range of movement of between approximately 60-120 degrees, although greater or lesser ranges of movement also can be utilized, and typically the corner of the panel will be formed as a radius curved corner, although it will also be possible for form substantially straight corners as needed or desired.

After the sewing head has completed the corner sewing operation, the rotatable clamp mechanism 75 is lowered and the sewing head and the clamp arm 76 will be rotated or otherwise moved in the direction of arrow 88, back to an initial or home position, as indicated in FIGS. 2C and 4C. The rotation of the clamp arm and sewing head further causes the panel to be pivoted about the sewn corner so as to reorient the panel to present the next side edge into an orientation or position for sewing therealong. Once the panel has been reoriented into a position for sewing its next side edge, the clamp arm can be disengaged from the panel, while the downstream puller assembly 66 (FIG. 3) can be reengaged with the panel for moving or pulling the panel along its path of travel for sewing, while the clamp arm is pivoted in the direction of arrow 88' (FIG. 2C) back to a home or initial position.

The side edge sewing and flanging and corner sewing and flanging operations thereafter are repeated for each of the side edges and corners of the panel. Once the last side edge of the panel has been completed, and as the panel is being sewn off, a flange material cutter 90 (FIG. 3) can be moved across the path of travel of the panel so as to cut any remaining flanging material therefrom. It further will be understood that in some instances where panels are already seamed, the flanging material may be cut or severed by the trimmer of the sewing head, rather than requiring actuation of the flange cutter 90 in order to cut and remove the flanging material from the panels.

Still further, the automatic panel sewing and flanging system of the present invention can be utilized for sewing materials other than a flanging material to a panel, as well as for sewing or seaming the edges and corners of a panel without attaching flanging or other materials thereto. For example, where a flanging material is not needed to be attached to the panel, the unseen side edges of the panel can be passed through the automatic panel sewing and flanging system for sewing at the side edges as discussed above, but without the feeding and attachment of the flanging material thereto.

Accordingly, the automatic panel sewing and flanging system of the present invention enables panels of varying sizes (i.e., king size, queen size, etc.) and thicknesses to be automatically trimmed and flanged as needed, with the flanging material generally being attached with a chain stitch and over edge stitch, thus forming a safety stitching along the side edges of the panels. Additionally, by fixing the panel in position and thereafter engaging its sewing about the corner of the panel by movement of the sewing head thereabout, substantially consistently sized, shaped and sewn/flanged corners, which additionally can have flanging material that is attached thereto, can be formed with pleating and/or puckering of the corner portions of the panels, and the flanging material attached thereto, being substantially minimized. As a result, more consistently sized and/or uniformly sewn panels can be produced to enable more consistent and/or faster assembly of mattresses, foundation sets and other articles utilizing such panels.

It will be understood by those skilled in the art that while the present invention has been discussed with reference to certain embodiments, various modifications, changes, additions, and deletions can be made thereto without departing from the spirit and scope of the present invention.

The invention claimed is:

1. A method of automatically attaching a flanging material to a panel, comprising:

moving the panel along a path of travel;

feeding the flanging material into the path of travel of the panel;

engaging and attaching the flanging material to a side edge of the panel with a sewing machine;

as a corner of the panel approaches the sewing machine, engaging and holding the panel in a substantially stationary position along the path of travel and moving the sewing machine along a path of travel about the corner of the panel to attach the flanging material to the corner of the panel; and after attaching the flanging material to the corner of the panel, reorienting the panel to present a next side edge for sewing.

2. The method of claim 1 and further comprising repeating the steps of engaging and attaching the flanging material to a side edge of the panel, attaching the flanging material to a corner of the panel, and reorienting the panel, until the flanging material has been attached to all side edges of the panel.

3. The method of claim 1 and wherein engaging and holding of the panel comprises engaging the panel with a clamp.

4. The method of claim 1 and wherein reorienting the panel comprises engaging the panel with a rotatable clamp mechanism and moving the clamp mechanism and sewing machine in engagement with the panel about a substantially arcuate path so as to rotate the panel to present the next side edge for sewing.

5. The method of claim 1 and wherein moving the sewing machine comprises rotating the sewing machine about a substantially arcuate path to form a radiused corner of the panel with the flanging material attached thereto.

6. The method of claim 1 and further comprising cutting the flanging material after sewing a last side edge of the panel.

7. The method of claim 1 and further comprising guiding the side edge of the panel through the sewing machine.

8. The method of claim 7 and wherein guiding the side edge of the panel comprises monitoring a location of the side edge and engaging and moving the side edge laterally with respect to the path of travel of the panel.

9. A method of automatically attaching a flanging material to a panel, comprising:

moving the panel along a path of travel;

feeding the flanging material into the path of travel of the panel;

engaging and attaching the flanging material to a side edge of the panel with a sewing machine;

detecting the corner of the panel approaching the sewing machine with a sensor and engaging the panel with the clamp to substantially stop further movement of the panel holding the panel in a substantially stationary position along the path of travel with the clamp and moving the sewing machine along a path of travel about the corner of the panel to attach the flanging material to the corner of the panel; and after attaching the flanging material to the corner of the panel, reorienting the panel to present a next side edge for sewing.

10. A system for attaching a flanging material to a panel, comprising:

a table for supporting the panel;

a supply of flanging material adjacent said table and adapted to feed the flanging material into contact with the panel;

a sewing assembly adjacent said table and comprising a sewing machine having at least one sewing needle for attaching the flanging material to a side edge of the panel as the panel is moved along a path of travel through said sewing assembly, and a rotatable base supporting said sewing machine and adapted to move said sewing machine along a path about a corner of a panel for sewing about the corner of the panel and attaching the flanging material to the corner of the panel; and a first clamp mechanism adapted to engage and hold the panel in a substantially stationary position on said table as said sewing machine is moved and sews about the corner of the panel;

a second clamp mechanism adapted to engage the panel and being moveable for reorienting the panel to present a next side edge of the panel for attaching the flanging material thereto.

11. The system of claim 10 and wherein said base comprises a turntable rotatable in a substantially arcuate motion of at least about 90°.

12. A system for attaching a flanging material to a panel, comprising:

a table for supporting the panel;

a supply of flanging material adjacent said table and adapted to feed the flanging material into contact with the panel;

a sewing assembly adjacent said table and comprising a sewing machine having at least one sewing needle for attaching the flanging material to a side edge of the panel as the panel is moved along a path of travel through said sewing assembly, and a rotatable base supporting said sewing machine and adapted to move said sewing machine along a path about a corner of a panel for sewing about the corner of the panel and attaching the flanging material to the corner of the panel;

a first clamp mechanism adapted to engage and hold the panel on said table as said sewing machine is moved about the corner of the panel; and a second clamp mechanism adapted to engage the panel and being moveable for reorienting the panel to present a next side edge of the panel for attaching the flanging material thereto;

wherein said second clamp mechanism comprises an arm pivotably mounted above said table and including a series of selectively actuatable clamps mounted therealong.

13. The system of claim 12 and wherein each clamp comprises a plate having a series of foot members mounted therealong and an actuator for moving said plate and foot members into clamping engagement with the panel.

14. The system of claim 10 and further comprising an active edge guide upstream from said sewing assembly.

15. The system of claim 14 and wherein said active edge guide comprises a guide member adapted to engage and move the panel with respect to its path of travel through the sewing assembly, and a sensor mounted along the path of travel to monitor the side edge of the panel and control said guide member for moving the panel.

16. A system for attaching a flanging material to a panel, comprising:

a table for supporting the panel;

a supply of flanging material adjacent said table and adapted to feed the flanging material into contact with the panel;

a sewing assembly adjacent said table and comprising a sewing machine having at least one sewing needle for attaching the flanging material to a side edge of the panel as the panel is moved along a path of travel through said sewing assembly, and a rotatable base supporting said sewing machine and adapted to move said sewing machine along a path about a corner of a panel for sewing about the corner of the panel and attaching the flanging material to the corner of the panel; and a first clamp mechanism adapted to engage and hold the panel on said table as said sewing machine is moved and sews about the corner of the panel;

a second clamp mechanism adapted to engage the panel and being moveable for reorienting the panel to present a next side edge of the panel for attaching the flanging material thereto; and a puller positioned downstream from said sewing assembly and adapted to engage and assist in moving the panel through said sewing assembly.

17. The system of claim 10 and further comprising a cutter moveable across the path of travel of the panel for cutting the flanging material.

18. A system for sewing the edges of a fabric panel, comprising:

a work table over which the panel is moved for sewing;

a sewing assembly including a sewing head moveably mounted adjacent said work table and having at least one sewing needle for sewing along the edges of the panel as the panel is moved along a path of travel through the sewing assembly;

a sensor positioned upstream from said sewing head and arranged to detect a corner of the panel approaching said sewing needle;

a clamp mechanism actuatable to engage and hold the panel in position on said work table for sewing about the corner of the panel; and wherein as the corner of the panel is detected as approaching said sewing needle, said sewing machine is moveable along a path about the corner of the panel for sewing about the corner of the panel as the panel is maintained in a substantially stationary position.

19. The system of claim 18 and further comprising a rotatable clamp mechanism adapted to engage the panel and moveable about a path of travel for reorienting the panel to present a next edge of the panel for sewing.

20. The system of claim 18 and wherein said sewing assembly further comprises a turntable on which said sewing machine is mounted, said turntable being rotatable with respect to said work table for moving said sewing machine about the corner of the panel.

21. The system of claim 18 and further comprising an active edge guide located upstream from said sewing assembly and comprising a guide member adapted to engage and move the panel with respect to its path of travel through said sewing assembly, and a sensor mounted along the path of travel of the panel to monitor the side edge of the panel and control said guide member for moving the panel.

22. The system of claim 19 and wherein said rotatable clamp mechanism is moveable with said sewing machine after said sewing machine is moved about the corner of the panel for reorienting the panel and presenting its next edge for sewing.

* * * * *